US005573383A

United States Patent [19]

Uemura et al.

[11] Patent Number: 5,573,383

[45] Date of Patent: Nov. 12, 1996

[54] BLOWER ASSEMBLY INCLUDING CASING HOUSING A FAN AND A MOTOR

[75] Inventors: Yukio Uemura; Kazushi Shikata, both of Kariya; Hiroshi Nonoyama, Toyota, all of Japan

[73] Assignee: Nippondenso Co., Ltd., Kariya, Japan

[21] Appl. No.: 404,081

[22] Filed: Mar. 14, 1995

[30] Foreign Application Priority Data

Mar. 16, 1994 [JP] Japan ..... 6-046185

[51] Int. Cl.[6] ..... F04B 17/00

[52] U.S. Cl. ..... 417/360; 417/371; 417/423.15; 248/222.52

[58] Field of Search ..... 417/360, 366, 417/368, 371, 423.14, 423.15, 424.2; 248/222.52

[56] References Cited

U.S. PATENT DOCUMENTS

| | | | |
|---|---|---|---|
| 2,800,272 | 7/1957 | McKee | 417/423.14 |
| 3,002,676 | 10/1961 | Papsdorf | 417/360 |
| 4,538,967 | 9/1985 | Furukawa . | |
| 5,117,656 | 6/1992 | Keck et al. | 417/360 |
| 5,232,341 | 8/1993 | Shier et al. | 417/360 |

FOREIGN PATENT DOCUMENTS

| | | | |
|---|---|---|---|
| 2236384 | 1/1975 | France | 417/366 |
| 59-142110 | 9/1984 | Japan . | |
| 59-187507 | 12/1984 | Japan . | |
| 63-11359 | 4/1988 | Japan . | |

*Primary Examiner*—Timothy S. Thorpe
*Assistant Examiner*—Ted Kim
*Attorney, Agent, or Firm*—Cushman, Darby & Cushman

[57] ABSTRACT

A plurality of mating tabs are provided on an opening for motor installation use disposed in an end plate of a casing. Along with this, a plurality of mating tabs and support tabs are provided on an outer peripheral end of a flange portion, and the flange portion is rotationally retained on the end plate through combination of these members. A protruding wall portion is disposed on a perimeter of an open portion for motor cooling-air use, and a guide rib of tapered configuration is provided adjacently to this wall portion. At the time of the foregoing rotational retaining, an end portion of a cooling-air passage of the flange portion is guided over this guide rib and mated with the protruding wall portion.

7 Claims, 8 Drawing Sheets

BLOWER ASSEMBLY INCLUDING CASING HOUSING A FAN AND A MOTOR

CROSS REFERENCE TO THE RELATED APPLICATION

This application is based upon and claims priority from Japanese Patent Application No. Hei 6-46185 filed Mar. 18, 1994 the contents of which are incorporated herein by reference.

BACKGROUND OF THE INVENTION

1. Field of the Invention

The present invention relates to a blower driving a fan by means of a motor and, more particularly, to an assembled structure including a casing which houses a fan for blower and a motor for fan-driving use. It is preferable to be used as a blower for example in automotive air-conditioning use.

2. Description of the Related Art

A blower of this type according to the prior art is known from Japanese Utility Model Application Laid-open No. 59-142110, wherein a flange member of a motor for fan-driving use is detachably and attachably retained by a rotational type retaining structure.

However, in a blower of this type, the amount of heat generated by the motor increases along with higher capacity of the motor, and because the phenomenon of motor overheating occurs, a portion of fan-blown air is circulated within the motor so as to perform motor cooling in order to prevent this phenomenon of motor overheating, but no consideration is made in the blower of the above-mentioned publication with regard to a passage connection structure for cooling air of this motor.

SUMMARY OF THE INVENTION

In light of the above-described point, it is an object of this invention to provide a blower wherein assembly of a flange member itself of a motor and passage connection of motor cooling air can be executed simply.

To attain the above-mentioned object, a blower including a fan for the blower, a motor to drive this fan for air-blowing use, a casing housing the fan for air-blowing use and forming a passage for air blown by means of the fan for air-blowing use, an air intake port formed in this casing on one axial end side surface of the fan for air-blowing use, an open portion for motor installation use of substantially circular configuration formed in the casing on another axial end side surface of the fan for air-blowing use, an open portion for motor cooling-air use formed in the casing on another axial end side surface of the fan for air-blowing use so as to open at an outer peripheral position from the open portion for motor installation use, a flange portion of disc configuration provided integrally on an outer periphery of the motor so as to extend in a radial direction of the motor and having an outer peripheral portion of disc configuration fixed on a perimeter portion of the open portion for motor installation use, and a cooling-air passage provided on this flange portion which causes to pass cooling air of the motor. And between the perimeter portion of the open portion for motor installation use of the casing and the outer peripheral portion of the flange portion, rotational type retaining structures, which cause these two members to be retained and disengaged by means of relative rotational movement in the circumferential direction of these members and, along with this, cause the open portion for motor cooling-air use and the cooling-air passage to be connected and disengaged, are provided.

Assembly and fixing on the fan casing side can be accomplished with extreme simplicity by means of rotational movement of the flange portion of the motor, and along with this, connection of the casing side open portion for motor cooling-air use and the cooling-air passage of the flange portion can be completed simultaneously, and by means of this there is the major effect that the assembly operation of the motor and casing of the air-blowing apparatus can be greatly simplified.

In another preferred mode, a protruding wall portion protruding to the flange portion side is formed on a perimeter portion of the open portion for motor cooling-air use of the casing, and along with this, a guide rib of tapered configuration the height of which increases gradually to a protrusion height approximately equivalent to the protruding wall portion at a rotational direction when the casing and the flange portion are caused to be retained is formed at a position immediately before a rotational direction of the protruding wall portion, so that an end portion of the cooling-air passage of the flange portion is guided over the guide rib to be mated with the protruding wall portion, and so even in an assembly structure according to rotational movement, connection of the open portion for motor cooling-air use of the casing and the cooling-air passage of the flange portion can be made a mating connection and not a flat connection, and air leakage of this passage connection portion can reliably be prevented.

In still another preferred mode, the guide rib is provided with a taper surface the height of which becomes increasingly larger, and a ridge portion flat surface formed on a ridge portion of this taper surface and having a height approximately equivalent to the protruding wall portion, and so an end portion of the foregoing cooling-air passage, after raising the taper surface of the foregoing guide rib, moves over the ridge portion flat surface in parallel to the end surface of the protruding wall portion, and the end portion of the cooling-air passage can smoothly mate with the protruding wall portion.

DETAILED DESCRIPTION OF THE PRESENTLY PREFERRED EXEMPLARY EMBODIMENTS

Figure 1:
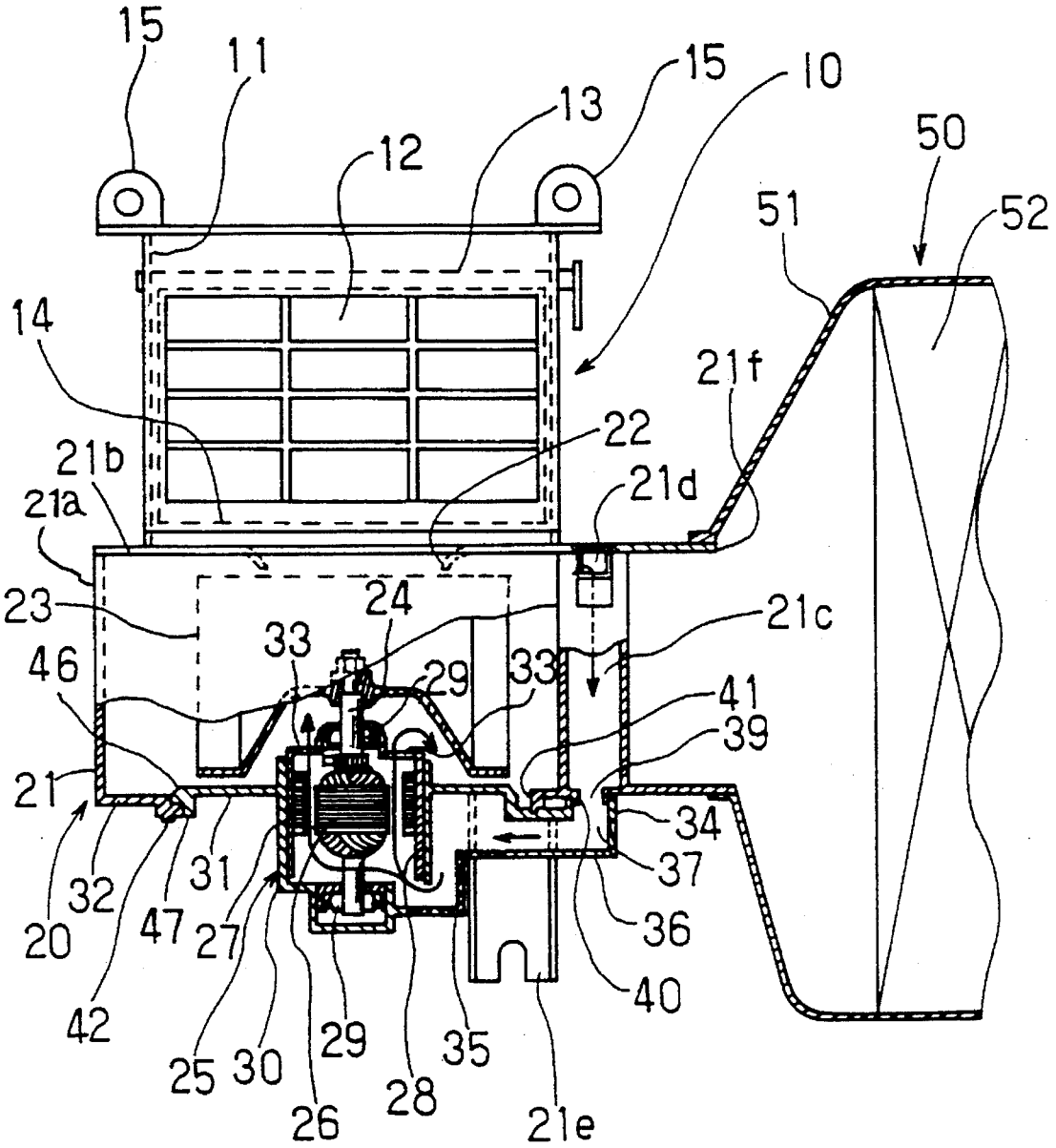
FIG. 1 is a partial sectional arrangement view of an air-conditioning apparatus for automotive use applying an air-blowing apparatus according to this invention.
Figure 2:
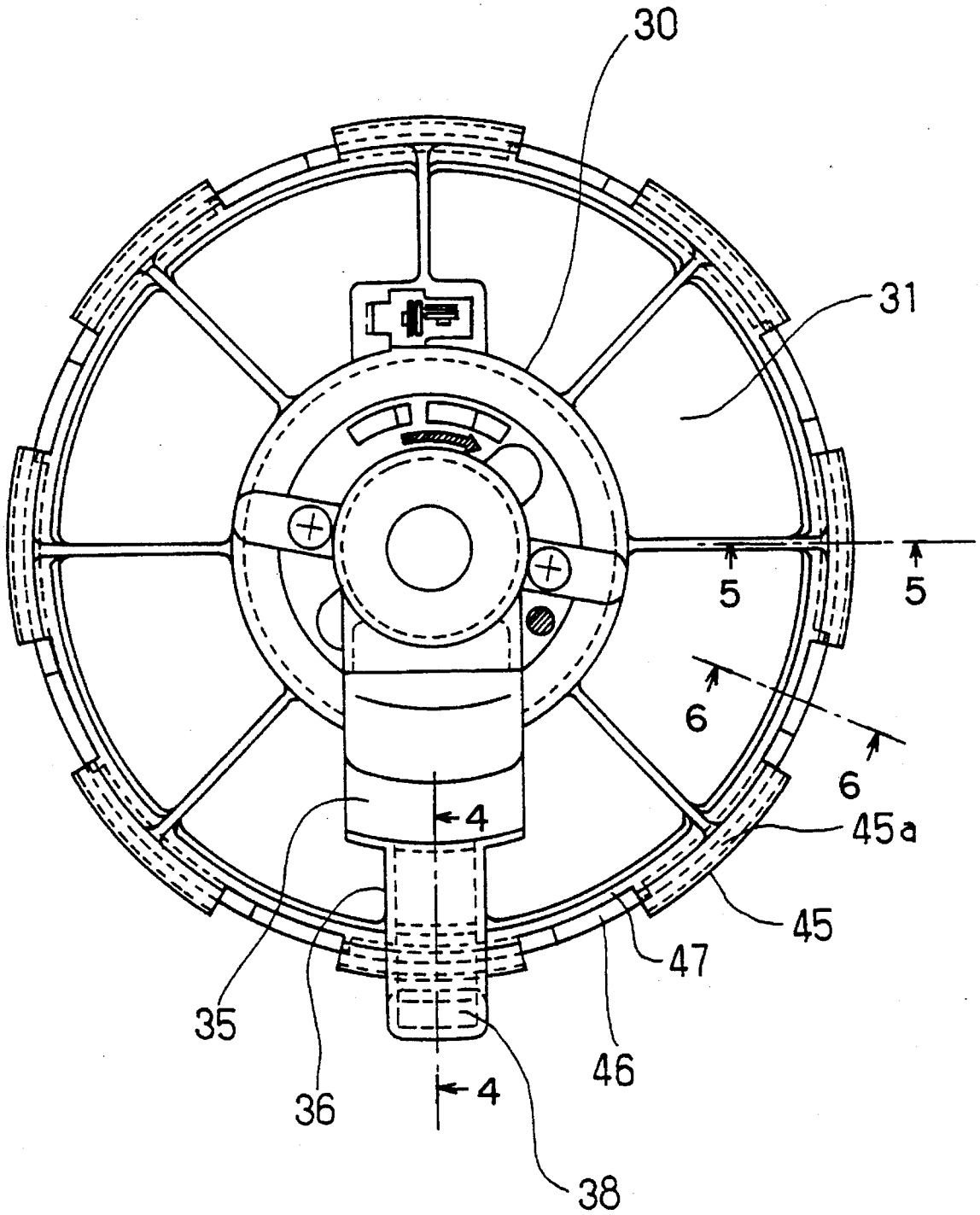
FIG. 2 is a front view of a motor portion in an apparatus according to this invention.
Figure 3:
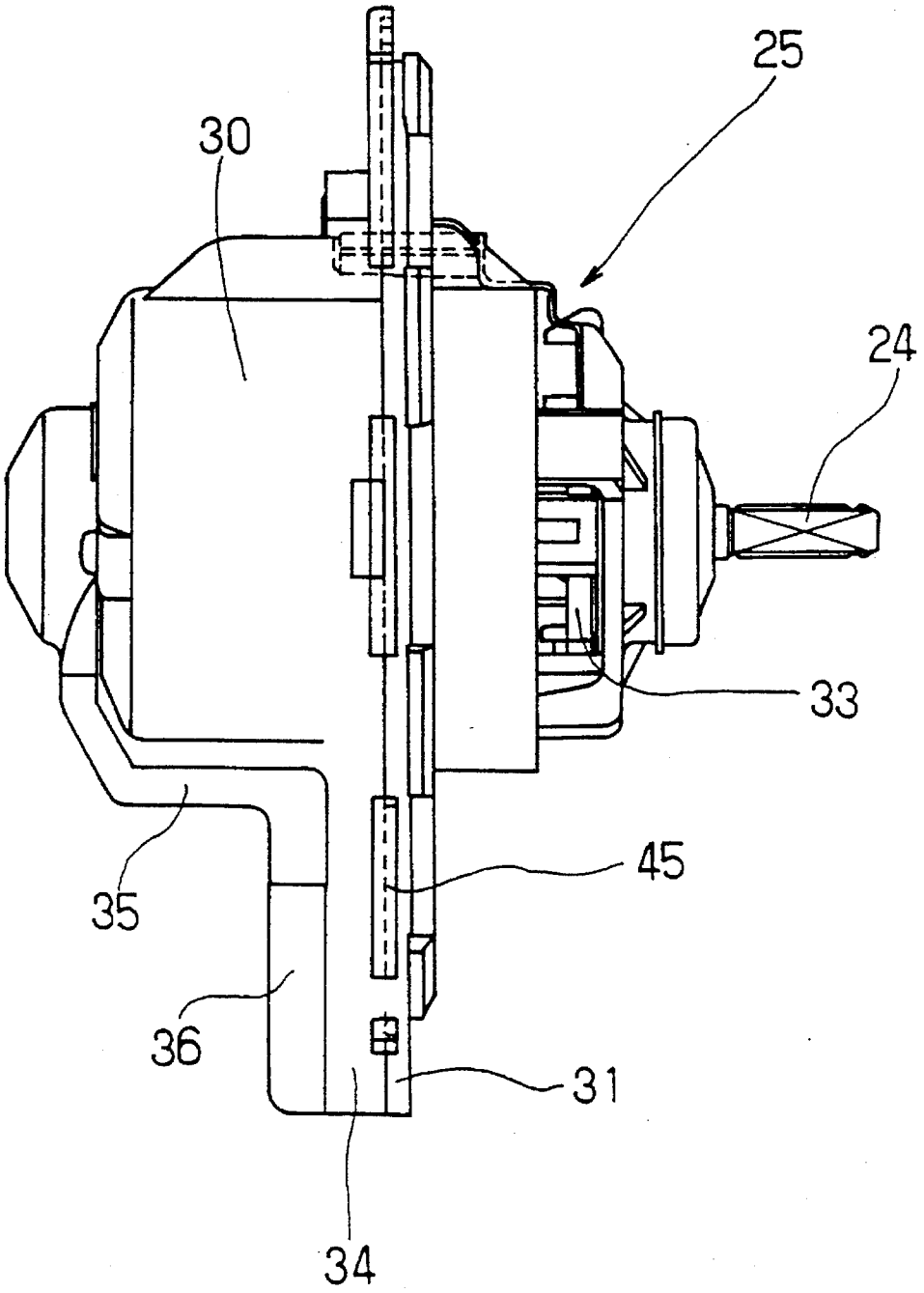
FIG. 3 is a side view of the same motor portion.
Figure 4:
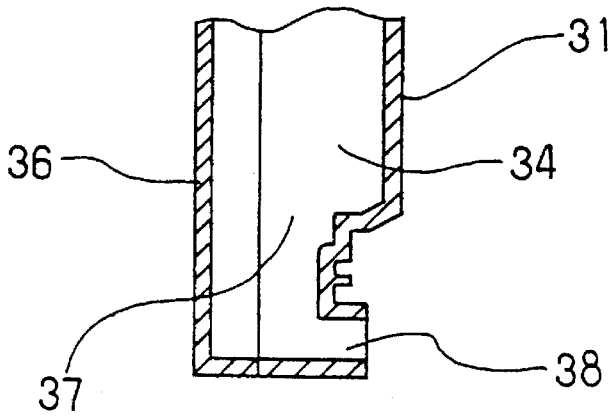
FIG. 4 is a 4—4 sectional view of FIG. 2.

An embodiment according to the invention will be described hereinafter with reference to the drawings. FIG. 1 indicates primarily a blower of an air conditioning apparatus for automotive use wherein this invention is applied, and the apparatus shown in FIG. 1 is normally installed on the passenger seat side below an instrument panel of the forward area within a passenger compartment of an automobile. Numeral 10 is an inner/outer air switching box composed of resin, and is disposed above a blower. This switching box 10 has thereabove an outer-air introduction port 11 to introduce air outside the passenger compartment, and has on a side surface an inner-air introduction port 12 to introduce air inside the passenger compartment. A rotatable inner/outer air switching damper 14 is disposed within the switching box 10 with a shaft 13 rotatable supported on this switching box 10 as the center, and the foregoing two introduction ports 11 and 12 are opened and closed by means of this damper 14.

Additionally, on the upper portion of the switching box 10 is provided a bracket for the purpose of installing this switching box 10 and blower 20 integrally on the vehicle body side. Accordingly, a casing 21 of scroll configuration for the blower 20 is disposed on the lower side of this switching box 10, and the space within this casing 21 is communicated with the lower space of the switching box 10 via an intake port 22 of bell-mouth configuration.

An eccentric type multiple-blade fan (sirocco fan) 23 is disposed within the casing 21, and this fan 23 is driven and rotated via a shaft 24 by means of a motor 25. This motor 25 is structured of an armature portion 26 which rotates integrally with the shaft 24, a magnet for magnetic field use 27 of cylindrical configuration, a yoke 28 of cylindrical configuration, a bearing 29, a motor case 30 composed of resin to house these, and so on.

Additionally, the casing 21 is structured of a main body case portion 21*a* composed of resin which forms a main body portion including an end plate 32 which forms a bottom plate, and an end plate 21*b* formed of a different piece of resin than this main body case portion 21*a*. An introduction passage portion 21*c* for motor cooling air is formed on a nose portion (tongue portion) of scroll configuration at the main body case portion 21*a*, and an intake port 21*d* for motor cooling air is opened on the top-end portion (intake port 22 side location) thereof. A bracket 21*e* for installation on the vehicle body is formed integrally on the lower side end plate 32 of the main body case portion 21*a*.

An exit portion 21*f* of the casing 21 is linked to an intake portion of a case 51 of a unit for cooling use 50 so as to blow air to a cooler (refrigeration cycle evaporator) 52 side within the case 51.

FIGS. 2 through 7 indicate concretely an assembled structure of the motor 25. A flange portion of substantially disc configuration which protrudes radially outwardly is formed integrally on an axial intermediate portion of the foregoing motor case 30, and the motor 25 is fixed via this flange portion 31 to the end plate (bottom plate) 32 on the lower side of the casing 21 by means of a rotational type retaining structure which will be described below.

An air exit port 33 (indicated also in FIG. 1) to discharge motor cooling air to a low-pressure portion of a fan 23 central portion within the case 21 is provided on an upper portion of the motor case 30, and crossing from a lower portion of the flange portion 31 to the central portion of the motor case 30, a groove-shaped portion 34 for the purpose of introducing motor cooling air within the case 30 is integrally formed to be bent perpendicularly. This groove-shaped portion 34 is formed in a configuration with a U-shaped cross-section, groove covers 35 and 36 of resin composition are mounted detachably on the open end surface of the U configuration thereof, and a cooling-air passage 37 (refer to FIG. 4) is formed by means of this groove-shaped portion and groove covers 35 and 36.

Furthermore, a rectangular-shaped entry end 38 of the foregoing groove-shaped portion 34 can be connected to an open portion for motor cooling-air use 39 open to the end plate 32 of the resin-made casing 21, and a rectangular-shaped protruding wall portion 40 (refer to FIGS. 7 and 8) which protrudes to the outer surface side (lower side) of the end plate 32 is formed integrally of resin on the perimeter of this open portion 39. The foregoing open portion 39 is open to the end plate 32 so as to be communicated with the introduction passage portion 21*c* indicated in FIG. 1. The open surface area of the above-mentioned entry end 38 is established, according this embodiment, so as to mate on the outer peripheral side of this protruding wall portion 40.

Figure 7:
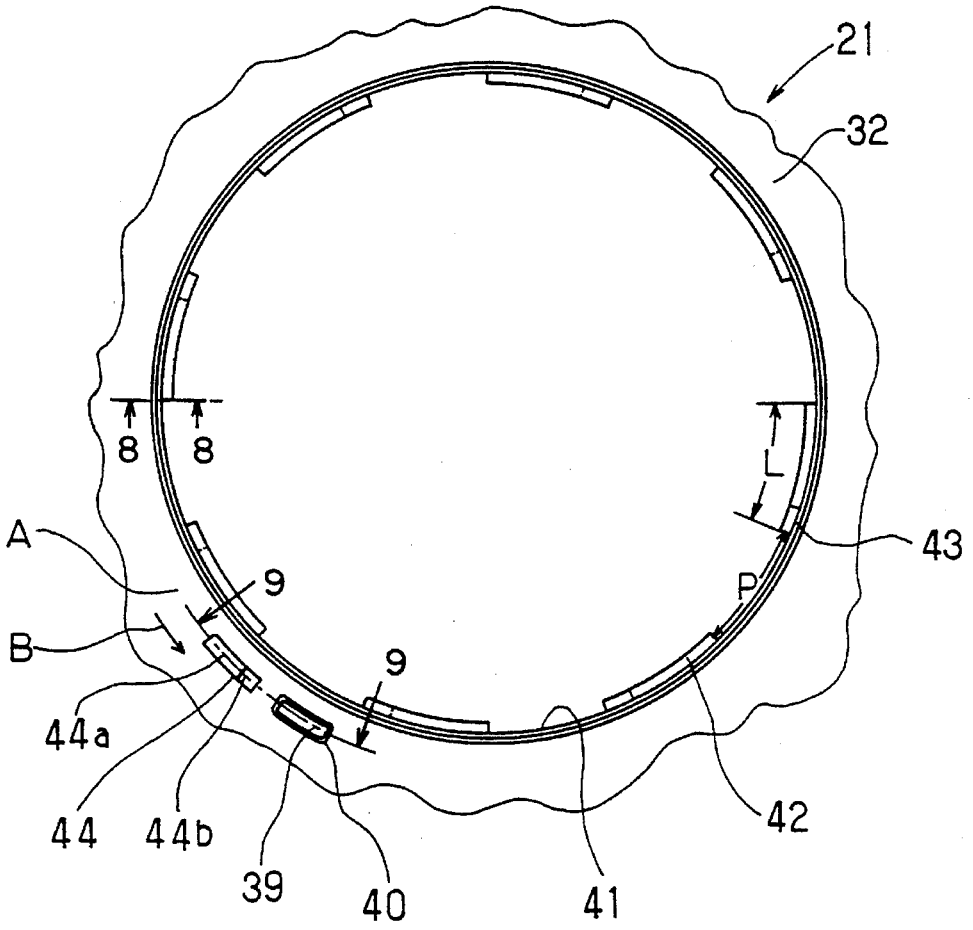
FIG. 7 is a front view of an end plate (bottom plate) of a fan casing portion in an apparatus according to this invention.
Figure 8:
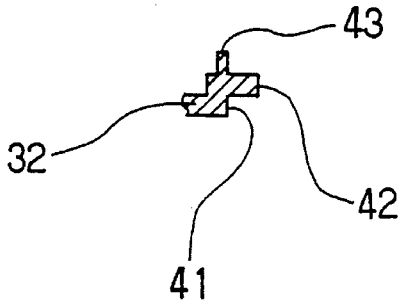
FIG. 8 is a 8—8 sectional view of FIG. 7.

As is indicated in FIG. 7, an open portion for motor installation use 41 of substantially circular configuration is formed on a central portion of the end plate 32 of the casing 21 so as to allow the fan 23 to be inserted within the casing 21 from this open portion 41, and a plurality of mating tabs 42, being according to this embodiment eight tabs, protruding inwardly radially are formed integrally on the inner peripheral surface of this open portion 41. Additionally, a ring-shaped protrusion 43 is formed integrally along the open portion 41 so as to protrude from the end plate 32 to the outer surface side (i.e., the side opposite the fan 23).

The foregoing open portion for motor cooling-air use 39 and wall portion 40 are disposed at a specified position (a specified position corresponding to the above-mentioned entry end 38) on an outer peripheral location of the above-mentioned open portion for motor installation use 41 and ring-shaped protrusion 43, and a guide rib 44 is formed integrally on the end plate 32 at a position immediately prior to the rotational direction in the flange portion rotational direction when the flange portion 31 is caused to be rotated and retained on the open portion 41 of the end plate 32.

Figure 9:
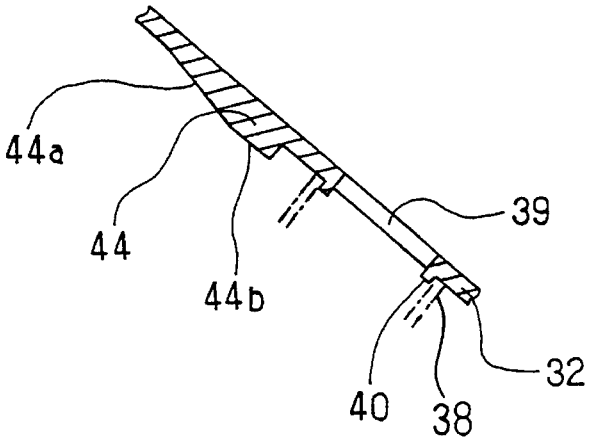
FIG. 9 is an 9—9 sectional view of FIG. 7.

As is indicated concretely in FIG. 9, this guide rib 44 is structured from a taper surface 44*a* which gradually rises from the surface of the end plate 32 toward the foregoing wall portion 40, and a ridge portion flat surface 44*b* which extends from a ridge portion of this taper surface 44*a* in parallel to the surface of the end plate 32. Herein, the protrusion height of the ridge portion flat surface 44*b* may be equivalent to the height of the wall portion 40, but for the purpose of improvement of assembly operation ease which will be described below, it is preferred that it be made slightly higher than the height of the wall portion 40, as is indicated in FIG. 9.

Figure 5:
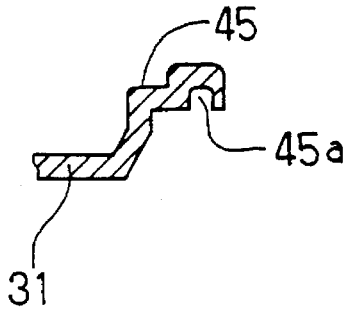
FIG. 5 is a 5—5 sectional view of FIG. 2.
Figure 6:
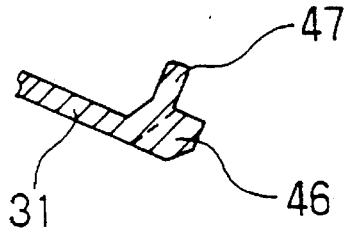
FIG. 6 is a 6—6 sectional view of FIG. 2.
Figure 10:
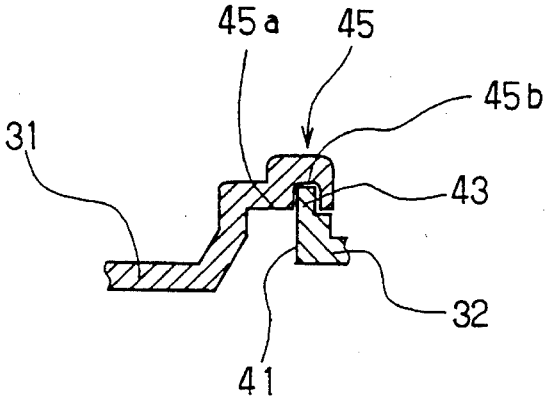
FIG. 10 is a partial sectional view indicating an assembly state of a motor flange portion and an end plate (bottom plate) of a fan casing portion in an apparatus according to this invention.

A plurality of mating tabs 45, being according to this embodiment eight, which mate with and retain the foregoing ring-shaped protrusion 43 are formed integrally on an outer peripheral end portion of the flange portion 31 so as to protrude radially outwardly. Additionally, as is indicated in FIGS. 5 and 10 the mating tabs 45 have a groove portion 45*a* with which the foregoing ring-shaped protrusion 43 mates. In addition, as is shown in FIG. 5 the mating tabs 45 are bent upwardly, i.e., from the surface of the flange portion 31 to the motor outer side (the outer side of the casing 21).

Additionally, a plurality of support tabs 46 (according to this embodiment, eight) are formed integrally on the outer peripheral end portion of the flange portion 31 between the above-described mating tabs 45 so as to protrude radially outwardly. The outer diameter to the outer peripheral tip of the portion where these support tabs 46 are formed is established so as to be larger than the diameter of the mating tab 42 inner peripheral portion which protrudes to the inner peripheral side at the open portion 41 of the end plate 32, such that the support tabs 46 can be supported by means of these mating tabs 42. In addition, a guide wall 47 is integrally formed adjacently to the support tabs 46. This guide wall 47 is formed bent from the surface of the flange portion 31 to the motor outer side, and guides the mating tab 42 tip surfaces of the open portion 41 of the end plate 32, as is indicated in FIG. 11.

Figure 12:
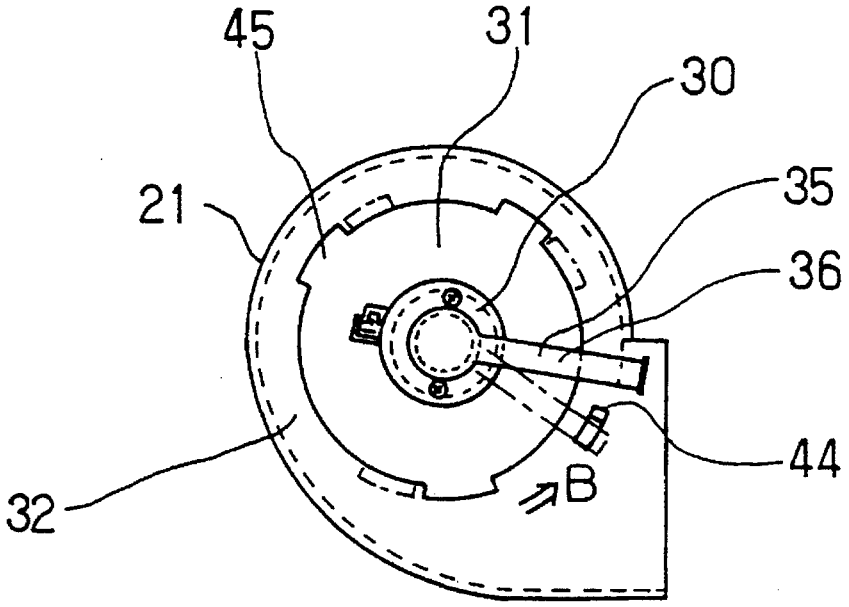
FIG. 12 is a front view indicating an assembly process of a motor flange portion and an end plate (bottom plate) of a fan casing portion in an apparatus according to this invention.

An assembly method of an air-blowing apparatus of the above-described structure according to this embodiment will be described next. In assembling to the casing 21 the motor 25 to which the fan 23 has been installed, the fan 23 portion is first inserted into the casing 21 through the opening, as shown in FIG. 7. At this time, the fan 23 portion is inserted while causing the entry end 38 of the cooling-air passage 37 formed across the flange portion 31 from the motor case 30 of the motor 25 to be positioned at point A in FIG. 7. When this is done, the support tabs 46 of the flange portion 31 are positioned between the mating tabs 42 of the end plate 32, and so there is no impediment to this insertion operation. Accordingly, after the mating tabs 45 of the flange portion 31 have contacted and mated with the ring-shaped protrusion 43 of the end plate 32, the motor 25 is caused to rotated in the direction of arrow B of FIG. 12.

When this is done, the entry end 38 of the cooling-air passage 37 rides upon the taper surface 44*a* of the guide rib 44, the entry end 38 flexes toward the outer side (the side opposite the fan 23) due to the elasticity of the resin, and at the ridge portion flat surface 44*b* the distance of the entry end 38 from the tip of the protruding wall portion 40 of the open portion for motor installation use 39 of the end plate 32 to the end plate 32 surface becomes larger, and if the motor 25 is caused to rotate further from this state, the entry end 38 moves along the ridge portion flat surface 44*b* in parallel with the end plate 32 surface, and next the entry end 38 moves upwardly of the protruding wall portion 40 and herein mates on the outer peripheral side of the protruding wall portion 40 by means of its own elastic return strength.

Figure 11:
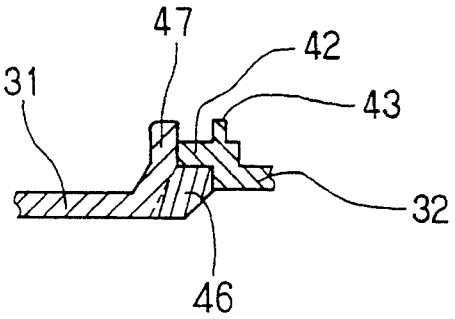
FIG. 11 is a partial sectional view of another area indicating an assembly state of a motor flange portion and an end plate (bottom plate) of a fan casing portion in an apparatus according to this invention.

In this state, as shown in FIG. 10, the ring-shaped protrusion 43 mates with the groove portion 45*a* of the mating tabs 45 of the flange portion 31, and along with this, the support tabs 46 of the outer peripheral side tips of the flange portion 31 are supported by means of the mating tabs 42 protruding toward the inner side of the open portion 41 of the end plate 32, as shown in FIG. 11. As a result of this, the end plate 32 comes to be squeezed and maintained between the flange portion 31 mating tabs 45 and support tabs 46, and the motor 25 is fixed to the end plate 32 of the casing 21 by means of the rotational type retaining structure.

In this fixed state of the motor 25, the entry end 38 of the cooling-air passage 37 is mated with the outer peripheral side of the protruding wall portion 40, and so air leakage of this passage connection portion can reliably be prevented. Additionally, the motor is reliably backed due to the existence of this passage mating portion (38 and 40) and the guide rib 44, and the fixing of the motor 25 can be made strong.

Figure 13:
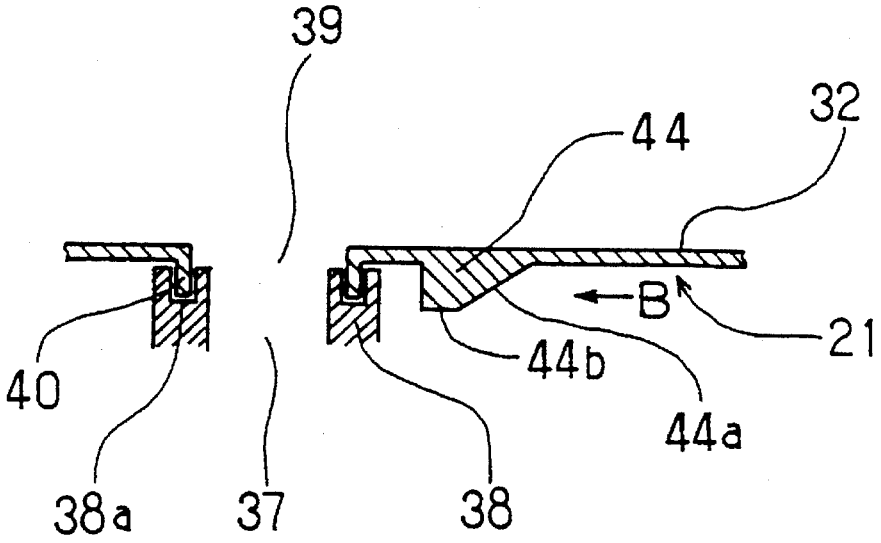
FIG. 13 is a partial sectional view indicating a second embodiment of an assembly structure of a motor flange portion and an end plate (bottom plate) of a fan casing portion in an apparatus according to this invention.

Another embodiment according to this invention will be described next. FIG. 13 indicates a second embodiment. According to this embodiment, a concavity 38*a* of configuration identical to the protruding wall portion 40 of the end plate 32 and into which this protruding wall portion 40 can be inserted is formed on the entry end 38 of the cooling-air passage 37, such that both of these members 38*a* and 40 are caused to be mated.

Figure 14:
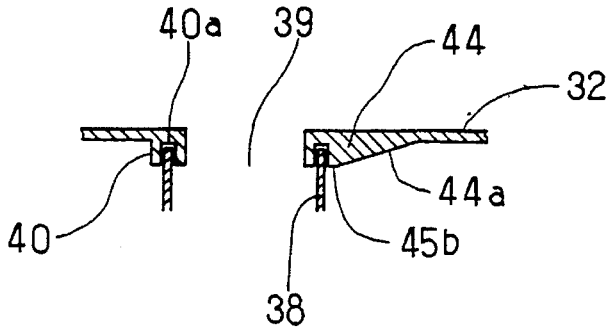
FIG. 14 is a partial sectional view indicating a third embodiment of an assembly structure of a motor flange portion and an end plate (bottom plate) of a fan casing portion in an apparatus according to this invention.

FIG. 14 indicates a third embodiment. a concavity 38*a* into which the tip portion of the entry end 38 can be inserted is formed on the protruding wall portion 40 of the end plate 32 such that both of these members 38*a* and 40 are caused to be mated.

According to the second and third embodiments in the above-mentioned FIGS. 13 and 14, the leakage air path of the connection portion of the open portion for motor cooling-air use 39 can be made longer, and so the seal performance of this connection portion can be improved.

Additionally, according to the third embodiment in FIG. 14, the protruding wall portion 40 is formed continuously with the ridge portion flat surface 44*b* of the guide rib 44.

Moreover, in order to cause seal performance to be even further enhanced, it is also acceptable to use a mode combining the structures of FIG. 13 and FIG. 14, i.e., a mode wherein concavities 38*a* and 40*a* are formed on both the entry end 38 and the protruding wall portion 40, and the entry end 38 and the protruding wall portion 40 are both mutually mated.

Furthermore, instead of making the circumferential length (L in FIG. 7) or the installed spacing (pitch P in FIG. 7) of the plurality of mating tabs 42 and support tabs 46 all identical, in the above-described assembly operation the flange portion 31 can be assembled always in a correct position with respect to the end plate 32 and misassembly can reliably be prevented by means of establishing a portion thereof to be non uniform (L or P for a portion only is made larger or smaller than other).

Figure 15A:
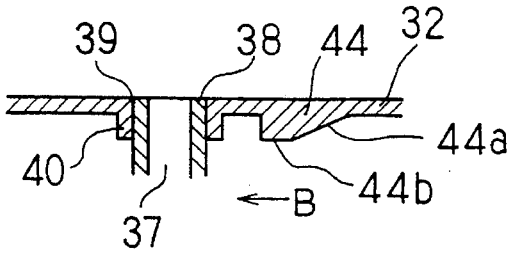
FIG. 15A through FIG. 15D are partial sectional views indicating fourth through seventh embodiments of an assembly structure of a motor flange portion and an end plate (bottom plate) of a fan casing portion in an apparatus according to this invention.

FIG. 15A through FIG. 15D indicate fourth through seventh embodiments according to this invention. FIG. 15A is a fourth embodiment wherein the entry end 38 of the cooling-air passage 37 of the motor 25 is caused to rotate while being guided over the guide rib 44, is caused to be positioned on the inner periphery of the protruding wall portion 40, and is inserted within the open portion for motor cooling-air use 39 of the end plate 32.

Figure 15B:
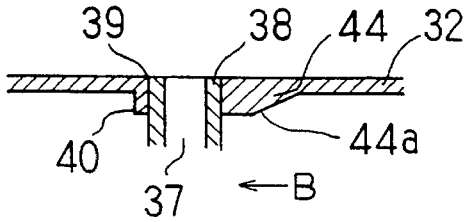

FIG. 15B is a fifth embodiment according to the foregoing embodiment, wherein the ridge portion flat surface 44b of the guide rib 44 and the protruding wall portion 40 are formed continuously.

Figure 15C:
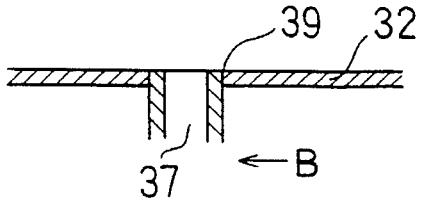

FIG. 15C is a sixth embodiment according to the foregoing embodiments of FIGS. 15A and 15B, wherein the protruding wall portion 40 and guide rib 44 are eliminated, and the entry end 38 of the cooling-air passage 37 of the flange portion 31 is caused to rotate over the surface of the end plate 32 and is inserted directly into the open portion for motor cooling-air use 39.

Figure 15D:
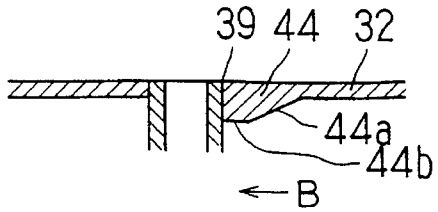

FIG. 15D is a seventh embodiment according to the foregoing embodiment of FIG. 15B, wherein the protruding wall portion 40 is eliminated, and entry end 38 of the cooling-air passage 37 is inserted directly into the open portion for motor cooling-air use 39 from the guide rib 44.

What is claimed:

1. A blower comprising:

a fan for blowing air;

a motor for driving said fan;

a casing for housing said fan and forming a passage for air blown by said fan, said casing having an air intake port on a surface at one axial end side of said fan, a first open portion for receiving said motor on a surface at another axial end side of said fan and being formed in a substantially circular configuration, and a second open portion for introducing cooling air to said motor on a surface at another axial end side of said fan so as to open at an outer peripheral position from said first open portion;

a disc-shaped flange portion provided integrally on an outer periphery of said motor so as to extend in a radial direction of said motor, having a disc-shaped outer peripheral portion fixed on a perimeter portion of said first open portion for receiving said motor, said flange portion forming therein a cooling-air passage to pass cooling air for said motor;

wherein between said perimeter portion of said first open portion for receiving said motor and said outer peripheral portion of said flange portion is provided a rotational type retaining structure which causes said casing and said flange portion to be connected by means of relative rotational movement in the circumferential direction of said casing and said flange portion and also causes said second open portion for cooling said motor and said cooling-air passage to be engaged wherein said casing includes:

a taper-shaped guide rib formed on a surface at another axial end side of said fan at an immediately upstream side of said second open portion against a rotational direction of said flange portion a height of said guide rib increasing gradually to said second open portion, so that an end portion of said cooling-air passage of said flange portion is guided over said guide rib to be engaged with said second open portion.

2. A blower according to claim 1, wherein said perimeter portion of said second open portion includes:

a protruding wall portion protruding toward said cooling-air passage of said flange portion; and the height of said taper-shaped guide rib increases gradually to a protrusion height approximately equivalent to said protruding wall portion, so that the end portion of said cooling air passage of said flange portion is guided over said guide rib to be engaged with said protruding wall portion.

3. A blower according to claim 2, wherein said protruding wall portion and said guide rib are formed to be continuous.

4. A blower according to claim 1, wherein an end portion forming said cooling-air passage of said flange portion is fitted with said second open portion.

5. A blower according to claim 1, wherein a plurality of retaining portions having a retaining length and retaining pitch are provided as said rotational type retaining structure, at least one of the group of said plurality of retaining portions having a non-uniform retaining length or pitch with respect to the rest of said retaining portions, and said plurality of retaining portions are mutually retained only at specified locations along a rotational direction.

6. A blower according to claim 1, wherein said casing is connected to an air path of an air-conditioning apparatus for automotive use.

7. A blower comprising:

a fan for blowing air;

a motor for driving said fan;

a casing for housing said fan and forming a passage for air blown by said fan, said casing having an air intake port on a surface at one axial end side of said fan, a first open portion for receiving said motor on a surface at another axial end side of said fan and being formed in a substantially circular configuration, and a second open portion for introducing cooling air to said motor on a surface at another axial end side of said fan so as to open at an outer peripheral position from said first open portion;

a disc-shaped flange portion provided integrally on an outer periphery of said motor so as to extend in a radial direction of said motor, having a disc-shaped outer peripheral portion fixed on a perimeter portion of said first open portion for receiving said motor, said flange portion forming therein a cooling-air passage to pass cooling air for said motor;

wherein between said perimeter portion of said first open portion for receiving said motor and said outer peripheral portion of said flange portion is provided a rotational type retaining structure which causes said casing and said flange portion to be connected by means of relative rotational movement in the circumferential direction of said casing and said flange portion and also causes said second open portion for cooling said motor and said cooling-air passage to be engaged, said perimeter portion of said second open portion including:

a protruding wall portion protruding toward said cooling-air passage of said flange portion; and a guide rib at an upstream side of said protruding portion against a rotational direction of said flange portion so as to form a groove therebetween, said guide rib having a taper portion having a height which increases gradually toward said protruding wall portion, and a flat portion having a height greater than a height of said protruding wall portion, so that an end portion of said cooling-air passage of said flange portion is guided over said guide rib to be engaged with said protruding wall portion in such a manner that one side wall of said end portion is fitted in said groove.

* * * * *